US005700613A

United States Patent [19]

Nogami et al.

[11] Patent Number: 5,700,613

[45] Date of Patent: Dec. 23, 1997

[54] PHOTOCONDUCTOR FOR ELECTROPHOTOGRAPHY

[75] Inventors: Sumitaka Nogami; Michihiro Kitazawa; Katsuhiro Sato, all of Kawasaki, Japan

[73] Assignee: Fuji Electric Co., Ltd., Kawasaki, Japan

[21] Appl. No.: 586,465

[22] Filed: Jan. 11, 1996

[30] Foreign Application Priority Data

Jan. 11, 1995 [JP] Japan ..... 7-002362

[51] Int. Cl.[6] ..... G03G 5/14

[52] U.S. Cl. ..... 430/58; 430/64; 430/73

[58] Field of Search ..... 433/58, 59, 64, 433/73, 74, 72

[56] References Cited

U.S. PATENT DOCUMENTS

| | | | |
|---|---|---|---|
| 4,487,824 | 12/1984 | Katagiri et al. | 430/73 |
| 4,963,451 | 10/1990 | Katayama et al. | 430/72 |
| 5,320,921 | 6/1994 | Oshiba et al. . | |

FOREIGN PATENT DOCUMENTS

| | | |
|---|---|---|
| 0 348 889 | 1/1990 | European Pat. Off. . |
| 37 00 521 | 7/1987 | Germany . |
| 44 06 244 | 9/1994 | Germany . |
| 57-188041 | 11/1982 | Japan . |
| 58-93062 | 6/1983 | Japan . |
| 60-111255 | 6/1985 | Japan . |
| 60-254144 | 12/1985 | Japan . |
| 61-110153 | 5/1986 | Japan . |
| 2-59767 | 2/1990 | Japan . |
| 2-48175 | 10/1990 | Japan . |
| 4-221963 | 8/1992 | Japan . |
| 4-261547 | 9/1992 | Japan . |
| 4-309959 | 11/1992 | Japan . |
| 4-310964 | 11/1992 | Japan . |
| 4-328567 | 11/1992 | Japan . |
| 4-348351 | 12/1992 | Japan . |

*Primary Examiner*—John Goodrow
*Attorney, Agent, or Firm*—Spencer & Frank

[57] ABSTRACT

A photoconductor for electrophotography includes a conductive substrate; an undercoating layer formed on the conductive substrate; a charge generation layer formed on the undercoating layer; and a charge transport layer formed on the charge generation layer, wherein the undercoating layer comprises a coating film containing as the main constituent thereof an addition compound containing iodine added thereto, and wherein the charge generation layer comprises a P-type charge generation material containing iodine added thereto.

6 Claims, 1 Drawing Sheet

PHOTOCONDUCTOR FOR ELECTROPHOTOGRAPHY

BACKGROUND OF THE INVENTION

1. Field of the Invention

The present invention relates to photoconductors for electrophotography which include an undercoating layer, a charge generation layer, and a charge transport layer, and more specifically the present invention relates to the undercoating layer and the charge generation layer of the photoconductors for electrophotography.

2. Description of the Prior Art

The photoconductors for electrophotography which use inorganic materials such as selenium, zinc oxide, cadmium sulfide have been widely used. Recently, however, organic photoconductors which use organic photoconductive materials represented by polyvinyl carbazole have come up due to the environmental consideration, cheaper cost, and light weight.

In recent years, double-layered laminate type photosensitive materials have been developed and put to practical use. Photosensitive materials of this type have a photosensitive layer with a photoconductive function divided into the function of receiving light and generating charge carriers, and the function of transporting the charge carriers generated. That is, as shown in FIG. 1, they have a photosensitive layer 2 on the electroconductive substrate 1, the layer being a laminate consisting of a charge generation layer 4 containing a charge generating substance 3 which functions to receive light and generate charge carriers, and a charge transport layer 6 containing a charge transporting substance 5 which functions to transport the charge carriers generated.

Organic photoconductive materials have many advantages, such that wide varieties of materials are available and can be chosen according to requirements; film formation is easy for the production of photosensitive materials; the resulting film is flexible; they are economical; they retain electric charges reasonably well and exhibit high sensitivity; and they may be selected based on the compatibility with the wavelengths of the exposure light used for image formation. Because of these advantages, research and development have been energetically performed, and organic photosensitive materials using these materials have found actual use.

For the conductive substrate 1, usually, an aluminum alloy cylinder is used. The charge generation layer 4 is formed by depositing a quinone pigment, perylene pigment, azo pigment, phthalocyanine pigment, or the like, or by coating a coating liquid in which one of these pigments is dispersed in a binder which facilitates forming a film. Especially, the phthalocyanine pigment is widely used in a photoconductors for a printers which use a semiconductor laser diode or a light emitting diode (LED) as the exposure light source thereof, since many phthalocyanine pigments exhibit high sensitivity to near infrared rays. The charge transport layer 6 is formed by coating a coating liquid in which one of amine compounds, enaimine compounds, hydrazone compounds, and the like is dispersed in a binder which facilitates forming a film.

To meet the recent requirements of down-sizing and cost reduction of the printers, it has been required for the photoconductors to exhibit higher sensitivity and to enhance stabilizing its properties when the photoconductors are repeatedly used in the printers.

For reducing the cost of the printers, the aluminum alloy cylinder which is used for the substrate of the photoconductor is not formed now by the conventional cutting work. Techniques have been developed for using a non-cut pipe such as an IE pipe manufactured by extrusion or ironing, or an ED pipe manufactured by drawing as the substrate cylinder.

Such the non-cut pipe has many stripe defects on its surface, and some stripe defects are as deep as several μm. To mend these defects, it has been proposed to coat the non-cut aluminum pipe with a resin layer, in which conductive powder of stannic oxide, indium oxide, and the like is dispersed, to the thickness of 10 to 20 μm as an undercoating layer (cf. Japanese Patent Application Publications No. 51185/1989, 48175/1990, 60177/1990, and 62861/1989). However, it is very difficult to form the resin coating film in which the conductive powder is sufficiently dispersed. And, it is also difficult to keep the coating liquid stably so that the conductive powder may neither segregate nor sediment.

To avoid these drawbacks, the following method has been proposed. The method uses a coating liquid in which a resin and an organo-metallic compound for the substitution of the above described conductive powder are dissolved (cf. Japanese Patent Application Publication No. 4904/1991, and Japanese Patent Application Laid-Open No. 59767/1990). However, this coating liquid is not still stable enough to apply the method in industrial scale.

Then, the following photoconductors have been proposed. The photoconductors is formed by coating a film of conductive resin such as alcohol-soluble polyamide as thick as 4 to 20 μm as the undercoating layer on the surface of the non machining aluminum pipe, the surface roughness Rmax is 5 μm or less. The photoconductors also exhibit excellent electrical properties (cf. Japanese Patent Application Laid-Open No. 221963/1992, 261547/1992, 309959/1992, 310964/1992, and 348351/1992). However, the electrical properties of the photoconductor, which have the above described undercoating resin layer therein, greatly change in the low temperature and low humidity environments, and in the high temperature and high humidity environments. The change in the electrical properties of the photoconductor is more drastic when the undercoating resin layer is thick. The change of the electrical properties is caused primarily by the large water absorbency of the resin layer. The electrical conduction of the resin layer is governed mainly by the migration of $H^+$ ions and $OH^-$ ions ionized from the water absorbed in the resin layer. That is, the change of the electrical properties of the photoconductor is caused by the ionic conduction.

For avoiding this problem and reducing the change of amount of the water absorbed in a resin due to the environmental conditions, the photoconductor having a thick undercoating layer which is composed of a bridged resin and a large amount of filler has been proposed. The photoconductor exhibits little deterioration (cf. Japanese Patent Application Laid-Open Nos. 328567/1992). However, even when these constituents are contained in the undercoating layer, the properties of the photoconductor tends to deteriorate with increasing thickness of the undercoating layer. More in detail, remanent potential rise is caused more often by the thicker undercoating layer. Or, charging capability lowering by repeated use and remanent potential rise are caused more often by the thicker undercoating layer.

Though various undercoating layer have been proposed to facilitate using the cheap non machining pipe, any undercoating layer that exhibits satisfactory properties has not been realized so far.

SUMMARY OF THE INVENTION

In view of the foregoing, it is an object of the present invention to provide, by using a cheap conductive substrate to that any specific surface smoothing is not applied, a photoconductor for electrophotography that exhibits excellent properties, which change little by the environments and repeated use, and facilitates obtaining excellent images.

According to the present invention, there is provided a photoconductor for electrophotography that comprises a conductive substrate; an undercoating layer formed on the conductive substrate; a charge generation layer formed on the undercoating layer; and a charge transport layer formed on the charge generation layer, wherein the undercoating layer comprises a coating film containing as the main constituent thereof an addition compound containing iodine added thereto, and the charge generation layer has a P-type charge generation material containing iodine added thereto.

The photoconductor may use a phthalocyanine pigment or a polycyclic quinone pigment for the P-type charge generation material.

The above and other objects, effects, features and advantages of the present invention will become more apparent from the following description of embodiments thereof taken in conjunction with the accompanying drawings.

DETAIL DESCRIPTION OF PREFERRED EMBODIMENTS

Figure 1:
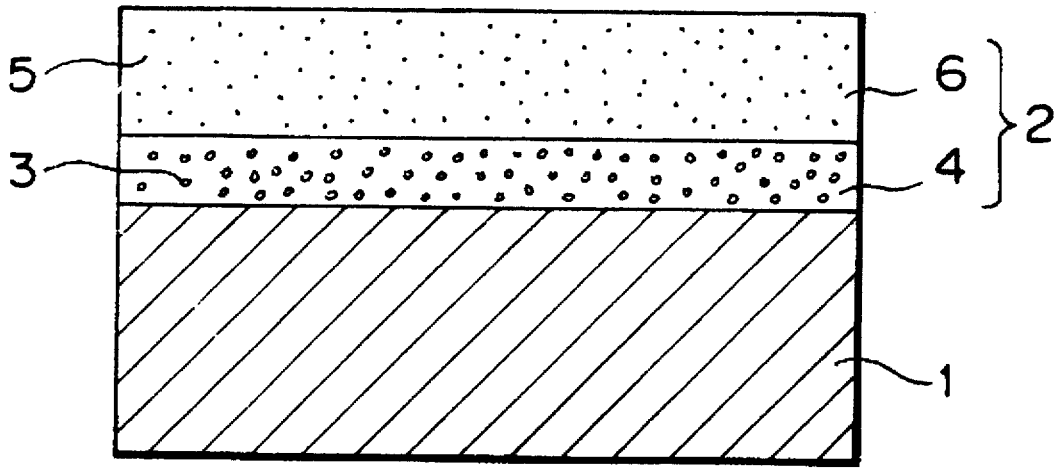
FIG. 1 (PRIOR ART)
FIG. 1 is a cross section view showing the conventional photoconductor for electrophotography.
Figure 2:
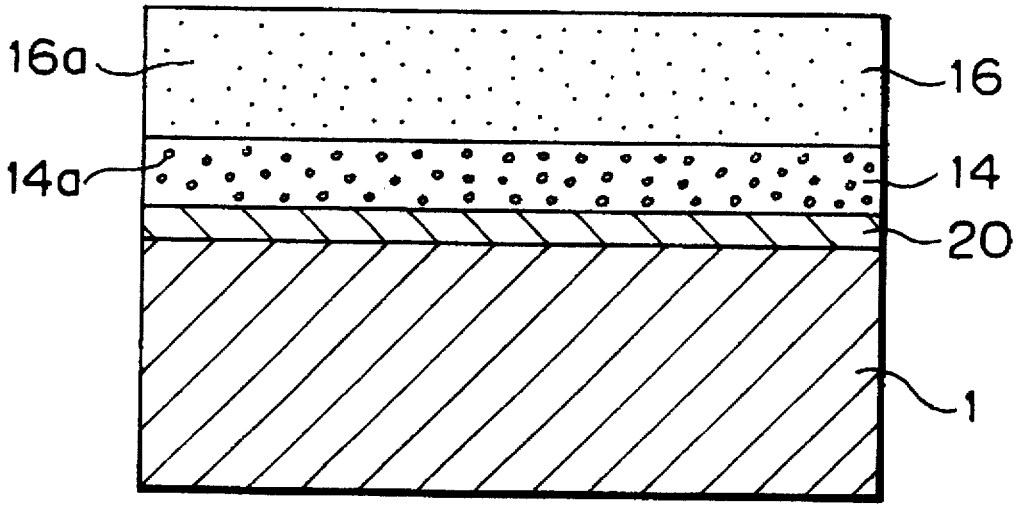
FIG. 2 is a cross section view showing the photoconductor for electrophotography of the present invention.

FIG. 2 is a cross section view showing the photoconductor for electrophotography of the present invention. As shown in FIG. 2, the photoconductor of the present invention comprises a conductive substrate 1, an undercoating layer 20 formed on the conductive substrate 1, a charge generation layer 14 formed on the undercoating layer 20, and a charge transport layer 16 formed on the charge generation layer 14.

In the present invention having above constitution, the undercoating layer 20 comprises a coating film containing as the main constituent thereof an addition compound containing iodine added thereto. And the charge generation layer 14 has a charge generation material 14*a* which is a P-type charge generation material containing iodine added thereto.

As for the conductive substrate 1, a dram, plate or sheet, made of aluminum, copper, zinc, nickel, iron, and the like or an alloy of these metals, may be used. A dram, plate or sheet, made from paper, plastics, glass, and the like may also be used. The non-conductive dram, plate or sheet is provided with electrical conductivity by laminating a conductive sheet, depositing metal, or by coating a conductive liquid thereon. A dram, plate or sheet, made of conductive material such as paper, plastics, glass, and the like blended with metal powder, carbon black, or metal oxide, may be used too. The surface of these conductive substrates may be treated, as required, by oxidation, with chemicals, with ozone, by ultraviolet ray irradiation, under plasma, etc.

The undercoating layer 20 comprises a coating film containing, as the main constituent thereof, an addition compound containing iodine added thereto. When the addition compound itself easily forms a film, e.g. polymers such as polyamide, the undercoating layer 20 is formed by coating the coating liquid into which such an addition compound is dissolved. When low molecular weight compounds which do not easily formed a film are used, the undercoating layer 20 is formed by coating the coating liquid into which such a low molecular weight compound is dissolved with a resin, monomer, or oligomer, which easily forms a film.

Nylon, poly(vinyl alcohol), poly(tetrahydrofuran), poly (N-vinylpyrrolidone), poly(4-vinylpyridine), and poly (acrylonitrile), are described, for example in J. of Mat. Sci., 21 (1986), pp. 604 to 610, as the compounds which easily form a film. Liner rubber having double bonds and urethane bridged rubber are listed in J. of Polymer Sci., Vol. 30 (1992), pp. 937 to 940 as the addition compounds with iodine added thereto. Polyurethane compounds having triple bonds are described, as the compounds which easily form a film, in J. of Polymer Sci., Vol. 31 (1993), pp. 3307 to 3315. And, high-molecular compounds which have double bonds and pyridine side chains are listed as the compounds which easily form a film in J. of Applied Polymer Sci., Vol. 50 (1993), pp. 601 to 606. In addition, amino resins may be used as the products which easily form a film. The amino resins are obtained by reacting urea compounds such as dicyandiamide, urea, thiourea, etc., or triazine compounds such as melamine, isomelamine, benzoguanamine, acetoguanamine, etc., with formaldehyde, and by etherificating the obtained methylol compounds with alcohol such as butanol or isobutanol. Or, mixtures or copolycondensation products of these compounds may also be used as the products which easily form a film.

Quinone compounds, described in Bull. Chem. Soc. Japan, Vol. 67 (1994), pp. 603 to 606, are used as the low molecular weight compounds which do not easily form a film.

Iodine is added to these compounds and products in advance to the coating of the coating liquid by dissolving iodine in the coating liquid containing these compounds or products, coating the coating liquid, and drying the coating liquid to form a film. Iodine is added to these compounds and products after the coating of the coating liquid by immersing the coated film in the liquid containing iodine, or by placing the coated film in the iodine vapor. By any methods, an excellent undercoating layer is obtained by adding 1 to 100 weight parts, preferably 3 to 50 weight parts, of iodine to the 100 weight parts of the compound. When the added amount of iodine is less than 1 weight part, excellent electrical conductivity is not obtained. When the added amount of iodine exceeds 100 weight parts, the charging capability lowers, and more deterioration is caused in the electrical properties after repeated use. The undercoating layer is preferably as thick as 0.1 to 30 μm, and more preferably as thick as 0.5 to 20 μm.

Organic or inorganic filler is added to the undercoating layer 20 for providing a light scattering function to the photoconductor used in the electrophotographic apparatus such as printers which use monochromatic light such as a laser beam as the exposure light. The organic or inorganic filler is added to the undercoating layer 20 also for hiding the coloring of the photoconductor or the contaminations and defects of the surface of the conductive substrate 1. For example, polyethylene powder, silicone resin powder, fluorine resin powder, zinc oxide, titanium oxide, calcium oxide, silica, kaolin, talc, etc. are used as the filler. It is preferable to add the filler to the undercoating layer 20 within the volumetric percent range of 20 to 60%. To prevent the undercoating layer 20 from deteriorating by ozone, NOX, etc., hindered phenol compounds, hindered amine compounds hindered piperidine compounds, sulfur compounds, phosphorus compounds, and the like are added alone or in mixture.

It is preferable to use a P-type charge generation material such as a phthalocyanine pigment or a polycyclic quinone pigment for the charge generation layer 14 formed on the undercoating layer 20.

Metal-free phthalocyanines or metal phthalocyanines are used alone or in combination. The metal of the metal phthalocyanines includes copper, silver, magnesium, zinc, aluminum, titanium, vanadium, iron, and silicon. These metals may be contained in the phthalocyanines in the form of metal halogenide or metal oxide. Though the metal phthalocyanines crystallize in various crystal forms, e.g. α form, β form, γ form, δ form, ε form, X form, τ form, the metal phthalocyanines may be used in any crystal forms.

As for the polycyclic quinone, polycyclic quinones as represented by the following general formulas (I), (II) and (III) are used alone or in combination.

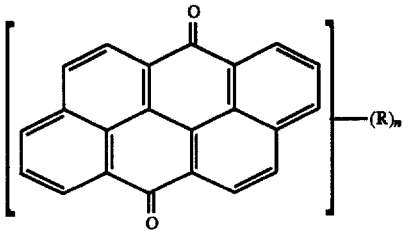

(I)

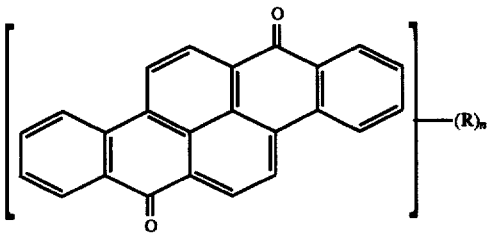

(II)

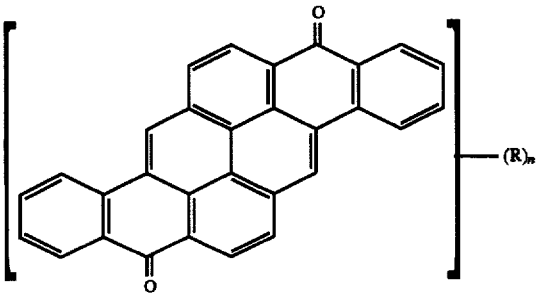

(III)

In the formulas (I), (II) and (III), R represents any one of halogen element, nitro group, cyano group, acyl group, alkyl group, and alkoxy group, and n is an integer of 0 to 4.

Iodine is added to the phthalocyanines and the polycyclic quinones of the invention. Iodine may be added in advance to or after the charge generation layer is formed. Iodine is added in advance to the formation of the charge generation layer 14 by exposing the formed charge generation layer to the iodine vapor or by immersing the formed charge generation layer 14 in the organic solvent into that iodine is dissolved. Iodine may be added more simply by dispersing and dissolving phthalocyanine, resin binder and iodine during the preparation of the coating liquid for the charge generation layer formation. Iodine may be added, after the charge generation layer 14 is formed, by exposing the deposited phthalocyanine film or the coating film, formed by coating the coating liquid in that phthalocyanine and resin binder are dispersed and dissolved, to the iodine vapor or by immersing the formed charge generation layer 14 or the coating film in the organic solvent into that iodine is dissolved. These methods of adding iodine are applicable to the polycyclic quinones.

It is preferable to addition 0.001 to 3 moles, more preferably 0.01 to 1 mol, of iodine to 1 mol of phthalocyanine or polycyclic quinone. The amount of iodine added is determined from the weight increase after the addition process. If less amount of iodine is added, the addition of iodine will shows no effects. If to much iodine is added, drawbacks such as charging capability lowering, remanent potential increase due to accumulated fatigue by repeated use will be caused.

Though the charge generation layer 14 may be formed by vapor deposition, it is more popular to form the charge generation layer 14 by coating and drying the coating liquid in that the charge generation material 14*a* and appropriate binder is dispersed and dissolved. Polycarbonate, polyester, poly(vinyl acetal), poly(acrylic ester) and their copolymer, poly(metacrylic ester) and its copolymer, vinyl acetate copolymer, vinyl chloride copolymer, polyurethane, and polyester may be used as the binder. The charge generation material 14*a* and the binder are blended at a weight ratio of 1/9 to 9/1. The charge generation layer 14 is formed as thick as 0.1 to 1 μm.

The known charge transport materials such as enaime compounds, styryl compounds, hydrazone compounds, and amine compounds may be used for charge transport material 16*a* in the charge transport layer 16. The charge transport layer 16 is formed by coating and drying the coating liquid in that one of these charge transport materials and a binder, that is soluble with the charge transport materials such as polycarbonate resin, polyester resin, polystyrene, styrene acrylate is dissolved. The charge transport layer 16 is formed as thick as 5 to 40 μm.

The reason why the photoconductor, that exhibits high sensitivity, low remanent potential, little lowering of charging capability after repeated use, and little remanent potential rise, is obtained by adding iodine to the undercoating layer 20 and the charge generation layer 14 has not been clarified yet. However, it is considered that the above described effects may be attributable to the improved affinity of the undercoating layer with iodine added thereto and the charge generation layer 14 with iodine added thereto, reduction of the energy gap between these layers, and the improved injection efficiency of the generated charges to the undercoating layer 20.

EMBODIMENT

Now the embodiments of the present invention will be explained. Preparation and Conditions for Film Formation of the Coating Liquid for the Undercoating Layer Coating liquids having compositions described in Tables 1 and 2 were prepared for the undercoating layer 20. The coating liquids were converted to undercoating layers under the film formation conditions as listed therewith. Undercoating layers containing iodine therein and undercoating layers containing no added iodine were prepared.

TABLE 1

| Coating Liquid No. | Composition of Coating Liquid for Undercoating Layer: Constituents | Wt. part | Conditions for Film Formation |
|---|---|---|---|
| 1 | Polyamide resin (Mitsui Toatsu Chemicals Inc.; Epokey H162-70T0 | 100 | Hardening at 100 C.° for 15 min after |

TABLE 1-continued

| Coating Liquid No. | Composition of Coating Liquid for Undercoating Layer: Constituents | Wt. part | Conditions for Film Formation |
|---|---|---|---|
| | Epoxy resin (Yuka Shell Epoxy Co., Ltd.; Epicoat 828) | 50 | coating. |
| | Iodine | 5 | |
| | Tetrahydrofuran | 500 | |
| 2 | Isocyanate resin (Mitsui Toatsu Chemicals Inc.; Olester P49-75S) | 17 | Hardening at 100° C. for 30 min after coating. |
| | Polyol resin (Mitsui Toatsu Chemicals Inc.; Olester Q164) | 100 | Subsequent immersion for 10 min in tetrahydrofuran solution containing 10% of iodine. |
| | Quinoline | 50 | |
| | Tetrahydrofuran | 500 | |
| 3 | Melamine resin (Mitsui Toatsu Chemicals Inc.; Uban 20HS) | 100 | Hardening at 140° C. for 15 min after coating. |
| | Isocyanate resin (DAINIPPON INK & CHEMICALS INK.; Burnock D550 | 20 | |
| | Iodine | 5 | |
| | Tetrahydrofuran | 500 | |

TABLE 1

| Coating Liquid No. | Composition of Coating Liquid for Undercoating Layer: Constituents | Wt. part | Conditions for Film Formation |
|---|---|---|---|
| 4 | Polyisoprene (cis form) (Aldrich Inc.) | 100 | Hardening at 80° C. for 30 min after coating. Subsequent exposure for whole day and night in a desiccator filled with iodine vapor. |
| | Dichloromethane | 500 | |
| 5 | Melamine resin (Mitsui Toatsu Chemicals Inc.; Uban 2020) | 100 | Drying at 140° C. for 30 min after coating. |
| | Urethane resin (Mitsui Toatsu Chemicals Inc.; Olester NP-1000) | 20 | |
| | Dioxane | 300 | |

Preparation of the Coating Liquid for the Charge Generation Layer

Coating liquids for the charge generation layer 14 were prepared by dispersing and dissolving the compositions described in Tables 3, 4 and 5 in a paint shaker.

TABLE 3

| Coating Liquid No. | Composition of Coating Liquid for Charge Generation Layer: Constituents | Wt. part |
|---|---|---|
| OG1 | X-type metal-free phthalocyanine (DAINIPPON INK & CHEMICALS INC.; Fastgen Blue 8120B) | 1 |
| | Vinyl chloride copolymer resin (Nippon Zeon Co., Ltd.; MR-110) | 1 |
| | Iodine | 0.005 |
| | Methyl chloride 100 | 100 |
| OG2 | 3.9-dibromoanthanthron (Ciba-Geigy Ltd.; Cibanone Brilliant Orange RK) | 1 |
| | Poly(vinyl butyral) resin (Sekisui Chemical Co., Ltd.; SLEK KS-1) | 0.5 |
| | Iodine | 0.005 |
| | Methyl ethyl ketone | 70 |

TABLE 4

| Coating Liquid No. | Composition of Coating Liquid for Charge Generation Layer: Constituents | Wt. part |
|---|---|---|
| OG3 | X-type metal-free phthalocyanine (DAINIPPON INK & CHEMICALS INC.; Fastgen Blue 8120B) | 1 |
| | Vinyl chloride copolymer resin (Nippon Zeon Co., Ltd.; MR-110) | 1 |
| | Iodine | 0.05 |
| | Methylene chloride | 100 |
| OG4 | 3.9-dibromoanthanthron (Ciba-Geigy Ltd.; Cibanone Brilliant Orange RK) | 1 |
| | Poly(vinyl butyral) resin (Sekisui Chemical Co., Ltd.; SLEK KS-1) | 0.5 |
| | Iodine | 0.05 |
| | Methyl ethyl ketone | 70 |

TABLE 5

| Coating Liquid No. | Composition of Coating Liquid for Charge Generation Layer: Constituents | Wt. part |
|---|---|---|
| OG5 | X-type metal-free phthalocyanine (DAINIPPON INK & CHEMICALS INC.; Fastgen Blue 8120B) | 1 |
| | Vinyl chloride copolymer resin (Nippon Zeon Co., Ltd.; MR-110) | 1 |
| | Methylene chloride | 100 |
| OG6 | 3.9-dibromoanthanthron (Ciba-Geigy Ltd.; Cibanone Brilliant Orange RK) | 1 |
| | Poly(vinyl butyral) resin | 0.5 |

TABLE 5-continued

| Coating Liquid No. | Composition of Coating Liquid for Charge Generation Layer: Constituents | Wt. part |
|---|---|---|
| | (Sekisui Chemical Co., Ltd.; SLEK KS-1) | |
| | Methyl ethyl ketone | 70 |

EMBODIMENTS 1 THROUGH 4

Undercoating layers were formed by coating the undercoating liquid No. 1 through No. 4 described in Tables 1 and 2 under the film formation conditions described in Tables 1 and 2 on an aluminum alloy cylinder 30 mm in outer diameter, 28 mm in inner diameter, 260 mm in length, and 5.0 μm in the maximum surface roughness Rmax. And, the charge generation layers described in Tables 3, 4 and 5 were formed on the thus formed undercoating layers by immersion coating and drying of the coating liquid CG1 for the charge generation layer in the combinations as described in Table 6. Photoconductors were fabricated by forming a charge transport layer to the thickness of 20 μm on each charge generation layer by coating and drying the coating liquid in that five weight parts of N, N'-diphenyl N, N'-bis (3-methyl phenyl)-[1, 1'-biphenyl]-4, 4' diamine and six weight parts of polycarbonate Z resin are dissolved in 40 weight parts of methylene chloride.

COMPARATIVE EXAMPLE 1

An undercoating layer containing no added iodine was formed by coating the coating liquid No. 5 that contains no added iodine under the conditions described in Tables 1 and 2. A comparative photoconductor (comparative example 1) was fabricated by coating the coating liquid CG3 of Tables 3, 4 and 5 containing a lot of added iodine for the charge generation layer. The other parameters for manufacturing the comparative example 1 were same with those for the embodiment 1 described in Table 6.

COMPARATIVE EXAMPLE 2 THROUGH 5

Comparative photoconductors (comparative examples) 2 through 5 were fabricated by coating the coating liquid CG5 of Tables 3, 4 and 5 containing no added iodine for the respective charge generation layers. The other parameters for manufacturing the comparative examples 2 through 5 were same with those for the embodiments 1 through 4 described in Table 6.

COMPARATIVE EXAMPLE 6

An undercoating layer containing no added iodine was formed by coating the coating liquid No. 5 that contains no added iodine under the conditions described in Tables 1 and 2. A comparative photoconductor (comparative example 6) was fabricated by coating the coating liquid CG6 of Tables 3, 4 and 5 containing no added iodine for the charge generation layer. The other parameters for manufacturing the comparative example 6 were same with those for the embodiment 1 described in Table 6.

TABLE 9

| Photoconductor No. | Coating Liquid for Undercoating Layer | Coating Liquid for Charge Generation Layer |
|---|---|---|
| Embodiment 1 | 1 | CG1 |
| Embodiment 2 | 2 | OG1 |
| Embodiment 3 | 3 | OG1 |
| Embodiment 4 | 4 | OG1 |
| Comparative example 1 | 5 | OG3 |
| Comparative example 2 | 1 | OG5 |
| Comparative example 3 | 2 | OG5 |
| Comparative example 4 | 3 | OG5 |
| Comparative example 5 | 4 | OG5 |
| Comparative example 6 | 5 | OG6 |

The electrical properties of the thus obtained photoconductors were evaluated in a photoconductor process testing apparatus. The photoconductors mounted on the photoconductor process testing apparatus were rotated at the circumferential speed of 78.5 mm/sec, and charged up at −600 V with a corotron. A potential under no irradiated light was measured as a dark potential Vo. Then, potential retention VKS was measured for 5 sec during that the photoconductors were left in a dark place. Then, a potential was measured 0.2 sec after irradiation of light at a wavelength of 780 nm and at a light intensity of 2 μW/cm2 as a bright potential Vi. Then, a potential was measured 1.5 sec after the light irradiation as a remanent potential Vt. In an ordinary temperature and ordinary humidity environment (temperature; 25° C., relative humidity; 50%), the dark potential Vo, the potential retention VKS, the bright potential Vi, and the remanent potential Vr were measured as the initial values after one cycle of the above described charging up and light irradiation process, and after 10000 cycles of charging up and irradiation. The results are listed in Table 7.

TABLE 7

| Photoconductor No. | Electrical Properties of Photoconductor: Initial Properties $V_o$ (V) | $V_{k5}$ (%) | $V_i$ (V) | $V_r$ (V) | Properties after 10000 times of Repeated Use $V_o$ (V) | $V_{k5}$ (%) | $V_i$ (V) | $V_r$ (V) |
|---|---|---|---|---|---|---|---|---|
| Embodiment 1 | −590 | 98 | −60 | −10 | −585 | 94 | −63 | −15 |
| Embodiment 2 | −585 | 97 | −70 | −15 | −580 | 93 | −74 | −17 |
| Embodiment 3 | −570 | 96 | −55 | −10 | −565 | 95 | −60 | −14 |
| Embodiment 4 | −575 | 97 | −60 | −20 | −571 | 96 | −63 | −24 |
| Comparative example 1 | −600 | 98 | −80 | −30 | −590 | 97 | −85 | −33 |
| Comparative example 2 | −580 | 91 | −80 | −30 | −560 | 81 | −96 | −61 |
| Comparative example 3 | −570 | 90 | −91 | −40 | −540 | 86 | −110 | −75 |
| Comparative example 4 | −560 | 90 | −84 | −50 | −530 | 84 | −96 | −89 |
| Comparative example 5 | −580 | 93 | −91 | −56 | −540 | 84 | −96 | −91 |
| Comparative example 6 | −590 | 94 | −100 | −60 | −520 | 87 | −120 | −100 |

As described in Table 7, the comparative example 1, having the undercoating layer that contains no added iodine and the charge generation layer formed from the coating liquid that contains a lot of added iodine, exhibits an initial bright potential Vi, and initial remanent potential Vr inferior to those of the embodiments of the invention in which iodine is added to their undercoating layer and the charge generation layer. And, large variations are also caused in the electrical properties of the comparative example 1 by the 10000 cycles of charging up and light irradiation.

The initial potential retention VKS and the bright potential Vi of the comparative examples 2 through 5, having a charge generation layer that contains no added iodine, are inferior to those of each embodiments. The comparative examples 2 through 5 exhibit a remanent potential Vr higher than those of the embodiments of the invention. And, large variations are also caused in the electrical properties of the comparative examples 2 through 5 by the 10000 cycles of charging up and light irradiation. Thus, it is obviously effective to add iodine to the undercoating layer and the charge generation layer.

The dark potential Vo, the potential retention VKS, the bright potential Vi, and the remanent potential Vr were measured in a low temperature and low humidity environment (temperature; 10° C., relative humidity; 10%), and in a high temperature and high humidity environment (temperature; 35° C., relative humidity; 85%). The results are listed in Table 8.

TABLE 8

| | Electrical Properties of Photoconductor | | | | | | | |
|---|---|---|---|---|---|---|---|---|
| | Initial Properties under Low Temp. & Low Humidity | | | | Initial Properties under High Temp. & High Humidity | | | |
| Photoconductor No. | VO (V) | Vk5 (%) | Vi (V) | Vr (V) | VO (V) | Vk5 (%) | Vi (V) | Vr (V) |
| Embodiment 1 | −595 | 98 | −70 | −15 | −590 | 96 | −55 | 7 |
| Embodiment 2 | −590 | 97 | −75 | −18 | −585 | 94 | −64 | −10 |
| Embodiment 3 | −577 | 95 | −60 | −15 | −570 | 93 | −50 | −6 |
| Embodiment 4 | −580 | 96 | −67 | −24 | −575 | 94 | −56 | −15 |
| Comparative example 1 | −610 | 97 | −86 | −34 | −600 | 94 | −74 | −20 |
| Comparative example 2 | −590 | 94 | −130 | −60 | −570 | 89 | −24 | −20 |
| Comparative example 3 | −595 | 96 | −150 | −70 | −560 | 84 | −36 | −31 |
| Comparative example 4 | −584 | 93 | −141 | −89 | −520 | 91 | −40 | −26 |
| Comparative example 5 | −596 | 97 | −156 | −90 | −530 | 94 | −46 | −21 |
| Comparative example 6 | −600 | 98 | −160 | −110 | −540 | 92 | −41 | −28 |

As Table 8 indicates, larger variations are caused by the change of the environment in the properties of the comparative examples than in those of the embodiments of the invention. From the view point of less variation with environmental change, it is obviously effective to add iodine to the undercoating layer and the charge generation layer.

EMBODIMENTS 5 THROUGH 8

Undercoating layers were formed by coating the undercoating liquid No. 1 through No. 4 described in Tables 1 and 2 under the film formation conditions described in Tables 1 and 2 on an aluminum alloy cylinder 60 mm in outer diameter, 58 mm in inner diameter, 260 mm in length, and 4.0 μm in the maximum surface roughness Rmax. And, the charge generation layers described in Tables 3, 4 and 5 were formed to the thickness of 0.2 μm on the thus formed undercoating layers by immersion coating and drying of the coating liquid CG2 for the charge generation layer in the combinations as described in Table 9. Photoconductors of the embodiments 5 through 8 were fabricated by forming a charge transport layer in the same way as in the embodiments 1 through 4 of the invention.

COMPARATIVE EXAMPLE 7

An undercoating layer containing no added iodine was formed by coating the coating liquid No. 5 described in Tables 1 and 2 that contains no added iodine under the conditions described in Tables 1 and 2. A comparative photoconductor (comparative example 7) of Table 9 was fabricated by coating the coating liquid CG4 of Tables 3, 4 and 5 containing a lot of added iodine for the charge generation layer. The other parameters for manufacturing the comparative example 6 were same with those for the embodiment 5 described above.

COMPARATIVE EXAMPLE 8 THROUGH 11

Comparative photoconductors (comparative examples 8 through 11) of Table 9 were fabricated by coating the coating liquid CG5 of Tables 3, 4 and 5 containing no added iodine for the respective charge generation layers. The other parameters for manufacturing the comparative examples 8 through 11 were same with those for the embodiments 5 through 8 described in Table 9.

COMPARATIVE EXAMPLE 12

An undercoating layer containing no added iodine was formed by coating the coating liquid No. 5 that contains no added iodine under the conditions described in Tables 1 and 2. A comparative photoconductor (comparative example 12) of Table 9 was fabricated by coating the coating liquid CG6 of Tables 3, 4 and 5 containing no added iodine for the charge generation layer. The other parameters for manufacturing the comparative example 12 were same with those for the embodiment 5 of Table 9.

TABLE 9

| Photoconductor No. | Coating Liquid for Undercoating Layer | Coating Liquid for Charge Generation Layer |
|---|---|---|
| Embodiment 5 | 1 | CG2 |
| Embodiment 6 | 2 | CG2 |
| Embodiment 7 | 3 | CG2 |
| Embodiment 8 | 4 | CG2 |
| Comparative example 7 | 5 | CG4 |
| Comparative example 8 | 1 | CG5 |
| Comparative example 9 | 2 | CG5 |
| Comparative example 10 | 3 | CG5 |
| Comparative example 11 | 4 | CG5 |
| Comparative example 12 | 5 | CG6 |

The thus obtained photoconductors were evaluated in a copying machine (PF-3270 commercially supplied from Matsushita Electric Industrial Co., Ltd.). The initial dark potential of the photoconductors. Vd were set at −800 V, and the photoconductors were exposed to a white light until the irradiated light quantity reached 101 lux·sec. The sensitivity E1/2 was measured as the irradiated quantity of light necessary for the bright potential Vi to reach −100 V. And, the remanent potential Vr was measured as the potential at the irradiated light quantity of 101 lux·sec.

The dark potential Vd, the sensitivity E1/2, and the remanent potential Vr were measured in an ordinary temperature and ordinary humidity environment (temperature; 25° C., relative humidity; 50%), after one cycle, as the initial values, consisting of the above described charging up and light irradiation process, and after 10000 cycles of charging up and light irradiation. Here, the initial dark potential Vd of each photoconductor of the comparative examples is defined as the potential when the comparative photoconductor is charged under the condition that the initial dark potential Vd of the photoconductor of Example 5 is −800V. The results are listed in Table 10.

TABLE 10

| Photoconductor | Electrical Properties of Photoconductor | | | | | | | |
|---|---|---|---|---|---|---|---|---|
| | Initial Properties | | | | Properties after 10000 times of Repeated Use | | | |
| No. | Vd | Vi | E½ | Vr | Vd | Vi | E½ | Vr |
| Embodiment 5 | −800 | −100 | 2.4 | −30 | −790 | −85 | 2.7 | −37 |
| Embodiment 6 | −800 | −100 | 3.1 | −27 | −780 | −90 | 3.4 | −34 |
| Embodiment 7 | −800 | −100 | 3.2 | −35 | −777 | −91 | 3.7 | −40 |
| Embodiment 8 | −800 | −100 | 2.6 | −26 | −791 | −89 | 3.1 | −31 |
| Comparative example 7 | −800 | −100 | 2.5 | −40 | −784 | −87 | 2.9 | −48 |
| Comparative example 8 | −810 | −100 | 4.1 | −80 | −710 | −70 | 6.7 | −120 |
| Comparative example 9 | −820 | −100 | 4.8 | −60 | −720 | −60 | 7.1 | −100 |
| Comparative example 10 | −800 | −100 | 5.0 | −74 | −710 | −50 | 9.0 | −124 |
| Comparative example 11 | −780 | −100 | 3.9 | −81 | −720 | −80 | 7.4 | −160 |
| Comparative example 12 | −760 | −100 | 3.8 | −60 | −700 | −60 | 8.1 | −150 |

As Table 10 indicates, the comparative example 7 exhibits a high initial remanent potential Vr, and large variations of the dark potential Vd and the remanent potential Vr after 10000 cycles of charging up and light irradiation. The comparative example 8 exhibits a sensitivity E1/2 and dark potential Vd inferior to those of the embodiments 8 through 11 of the invention. And, large variations are caused in the electrical properties of the comparative example 8. The comparative example 12 exhibits a low dark potential Vd, inferior sensitivity E1/2, and inferior remanent potential Vr. And, large variations are also caused in the electrical properties of the comparative example 12. Thus, it is obviously effective to add iodine to the undercoating layer and the charge generation layer.

As has been explained so far, the photoconductor for electrophotography of the present invention comprises a conductive substrate; an undercoating layer formed on the conductive substrate; a charge generation layer formed on the undercoating layer; and a charge transport layer formed on the charge generation layer, wherein the undercoating layer comprises a coating film containing as the main constituent thereof an addition compound containing iodine added thereto, and the charge generation layer comprises a P-type charge generation material containing iodine added thereto.

The photoconductor of the invention facilitates using cheap conductive substrate, the surface thereof is not specifically smoothed. And, the photoconductor of the invention facilitates obtaining excellent properties which show little variations by environmental change and repeated use, and therefore, facilitates obtaining excellent images stably. Thus, cheap and excellent photoconductors for electrophotography are obtained by the present invention.

By using a phthalocyanine pigment for the P-type charge generation material, suitable photoconductors are obtained for electrophotographic apparatuses, e.g. laser beam printers, which use near-infrared exposure light. And, by using a polycyclic quinone pigment for the P-type charge generation material, suitable photoconductors are obtained for electrophotographic apparatuses, e.g. copying machines, which use white exposure light.

The present invention has been described in detail with respect to preferred embodiments, and it will now be that changes and modifications may be made without departing from the invention in its broader aspects, and it is the intention, therefore, in the appended claims to cover all such changes and modifications as fall within the true spirit of the invention.

What is claimed is:

1. A photoconductor for electrophotography, comprising:

a conductive substrate;

an undercoating layer formed on the conductive substrate;

a charge generation layer formed on the undercoating layer; and a charge transport layer formed on the charge generation layer, wherein the undercoating layer comprises a coating film containing as the main constituent thereof an addition compound containing iodine added thereto, and wherein the charge generation layer comprises a P-type charge generation material containing iodine added thereto.

2. The photoconductor for electrophotography as claimed in claim 1, wherein the P-type charge generation material comprises a phthalocyanine pigment.

3. The photoconductor for electrophotography as claimed in claim 2, wherein the phthalocyanine pigment is selected from the group consisting of copper, silver, magnesium, zinc, aluminum, titanium, vanadium, iron, silicon, metal halogenide thereof, metal oxide thereof, and mixture thereof.

4. The photoconductor for electrophotography as claimed in claim 1, wherein the P-type charge generation material comprises a polycyclic quinone pigment.

5. The photoconductor for electrophotography as claimed in claim 4, wherein the polycyclic quinone pigment is at least one polycyclic quinone pigment selected from the group consisting of polycyclic quinones as represented by general formulas (I), (II), and (III):

(I)
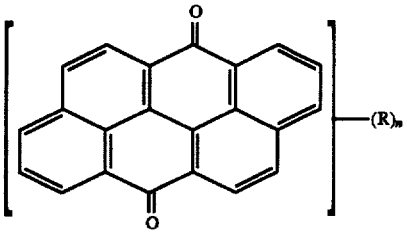
(II)
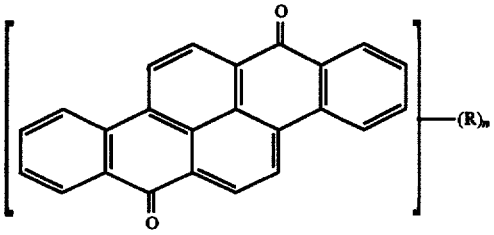
-continued
(III)
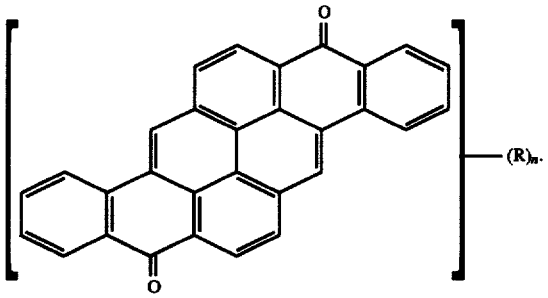
6. The photoconductor for electrography as claimed in claim 1, wherein the p-type charge generation material containing iodine added thereto contains iodine in an amount ranging from 0.001 to 3 moles of iodine per 1 mol of the p-type charge generation material.
* * * * *